US005566132A

United States Patent [19]

Janus et al.

[11] Patent Number: 5,566,132

[45] Date of Patent: Oct. 15, 1996

[54] ACOUSTIC TRANSDUCER

[75] Inventors: Robert S. Janus, Quaker Hill; Kurt J. Janecek, Waterford; Robert A. Roush, Norwich, all of Conn.

[73] Assignee: The United Sates of America as represented by the Secretary of the Navy, Washington, D.C.

[21] Appl. No.: 594,825

[22] Filed: Dec. 11, 1995

[51] Int. Cl.[6] ..... H04R 17/00

[52] U.S. Cl. ..... 367/163

[58] Field of Search ..... 367/163, 165, 367/173, 174

[56] References Cited

U.S. PATENT DOCUMENTS 5,068,836 11/1991 Steel ..... 367/163

5,329,499 7/1994 Molund et al. ..... 367/174

*Primary Examiner*—Daniel T. Pihulic

*Attorney, Agent, or Firm*—Michael J. McGowan; William F. Eipert; Prithvi C. Lall

[57] ABSTRACT

An acoustic transducer comprising a housing, and first and second stacks of transduction plates disposed within the housing for engaging opposed wall portions of the housing, the first and second stacks being adapted to be held in compression between the housing opposed wall portions. A threaded stud extends from the first stack to the second stack, and a nut is threadedly engaged with the stud and adjacent one of the stacks. Movement of the nut on the stud operates to move the stacks toward the housing walls, respectively, to compress the stacks, and operates to relax compressive force on the stacks to enable withdrawal of one of the stacks and replacement thereof.

6 Claims, 2 Drawing Sheets

ACOUSTIC TRANSDUCER

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

1. Field of the Invention

This invention relates to underwater sonar transducers and is directed more particularly to an acoustic transducer having stacks of piezoelectric ceramic transduction plates therein and having means for placing substantial compressive prestress on the ceramic plates and for relaxing the compressive stress to permit removal and replacement of one or more stacks of ceramic plates.

2. Description of the Prior Art

An underwater sonar transducer of the type described herein consists, in general, of a shell of some specified length which is hollow and of a generally elliptic cross section. The shell typically houses one or more stacks of piezoelectric ceramic plates and is designed to place a substantial compressive prestress on the ceramic plates. The plates of each stack are typically bound together, as by adhesive, though not in all cases. When an alternating voltage is placed on the piezo-electric plates, they expand and contract in such manner as to drive the narrow ends of the elliptical shell. This is transformed into large motions at the broad surfaces of the ellipse which are the major acoustic energy radiating surfaces.

Transducers of this general type are known and the elliptical shell may be of metal, formed to the desired dimensions with the desired internal space for carrying the stack of ceramic piezoelectric members, or it may be of a material such as glass fiber in an epoxy matrix. In either case, the one piece shell must be compressed significantly or flattened to increase the length of its hollow interior chamber so that the stack of ceramic plates can be inserted, after which the compressive force is removed, and the shell tends to return to its original shape, thus applying a static compressive pre-stress on the stack. It will be apparent that it is difficult to design and build a shell and a transducer stack wherein the dimensions of each are such as to provide just the right amount of prestress on the ceramic stack.

Further, once the transducer is assembled and the ceramic transduction plates are under prestress, it is difficult to extract from the shell a stack having one or more broken plates and to insert a new stack of transduction plates in place of the stack having the broken plate or plates.

It is therefore deemed beneficial to have means for exerting prestress on the transduction plates after the plates have been assembled in stacks and placed in a housing. It is further deemed beneficial that such means for exerting prestress are also adapted to relax compression of the plates, such that a stack may be removed from a housing and a new stack inserted into the housing.

SUMMARY OF THE INVENTION

An object of the invention is, therefore, to provide an acoustic transducer having means for prestressing the stacks of transduction plates after the plates have been placed in a housing.

A further object of the invention is to provide such a transducer wherein the prestress on the transduction plates can be adjusted after having been set.

A still further object of the invention is to provide such a transducer having means for relaxing the prestress compression on the transduction plates, such that one or more stacks can be removed from a housing and a replacement stack easily inserted into the housing.

With the above and other objects in view, as will hereinafter appear, a feature of the present invention is the provision of an acoustic transducer comprising a housing and first and second stacks of transduction plates disposed within the housing for engaging opposed wall positions of the housing, the first and second stacks being adapted to be held in compression between the housing opposed wall portions. A threaded stud extends from the first stack to the second stack and a nut is threadedly engaged with the stud and adjacent one of the stacks. Movement of the nut on the stud operates to move the stacks toward the housing walls, respectively, to compress the stacks. Alternatively, movement of the nut operates to relax compressive force on the stacks to enable withdrawal of one of the stacks and replacement thereof.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
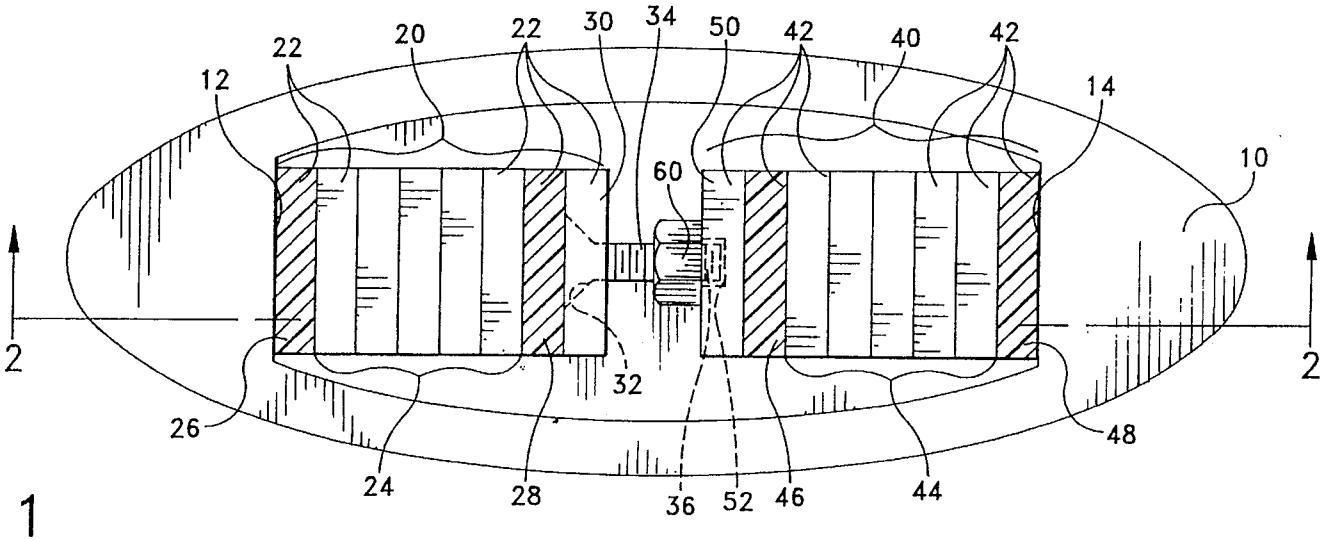
FIG. 1 is a top plan view of an acoustic transducer illustrative of an embodiment of the invention.

Referring to the drawings, it will be seen that the illustrative transducer includes a housing 10 of a generally elliptical tubular configuration, the housing 10 being formed of steel or of glass fiber in an epoxy matrix. The housing 10 is provided with opposed walls 12, 14 for engagement with ends of stacks including transduction plates, as will be described hereinafter.

A first stack 20 of first plates 22 includes a plurality of first transduction plates 24 disposed between first and second insulating plates 26, 28. The first stack 20 further includes a first metal plate 30 disposed adjacent insulating plate 28 and provided with threaded and countersunk holes 32. At least one threaded stud 34 (two shown in drawings) extends outwardly from first metal plate 30 in a direction lengthwise of first stack 20.

A second stack 40 of second plates 42 includes a plurality of second transduction plates 44 disposed between third and fourth insulating plates 46, 48. The second stack 40 further includes a second metal plate 50 disposed adjacent insulating plate 46. Second metal plate 50 is provided with a recess 52 therein providing a blind clearance hole for retaining the end of each of the studs 34.

The transducer housing 10 surrounds first and second stacks 20, 40, with wall 12 abutting insulating plate 26 and wall 14 abutting insulating plate 48. Thus, the housing walls 12, 14 are adapted to support the stacks 20, 40 in a state of compression therebetween.

A nut 60 is threadedly mounted on stud 34 and abuts the second metal plate 50.

In assembly, first metal plate 30 threadedly receives stud 34, which is secured in place, as by a weld. Nut 60 is threaded onto stud 34 and an end portion 36 of stud 34 is received in recess 52 of second metal plate 50. The metal plates 30, 50 are then attached to the electrical insulating plates 28, 46, respectively, as by adhesive.

To increase compression, nut 60 is turned on stud 34 such that the interaction of stud 34 and nut 60 causes stacks 20, 40 to move away from each other, toward housing walls 12, 14, respectively, to increase compression of the stacks 20, 40. If, subsequently, compression is found to be too high or insufficient, turning of nut 60 operates to selectively increase or decrease compression.

Inasmuch as the transduction plates 24, 44 are of a ceramic material, breakage of such plates is common. To remove and replace a stack having one or more broken transduction plates, nut 60 is turned so as to release, or relax, the compression of the stacks, so that one or more stacks may be removed and new stacks inserted. In some instances, the plates are not bound to each other and in such instances, the invention described herein permits removal and replacement of individual plates.

Figure 2:
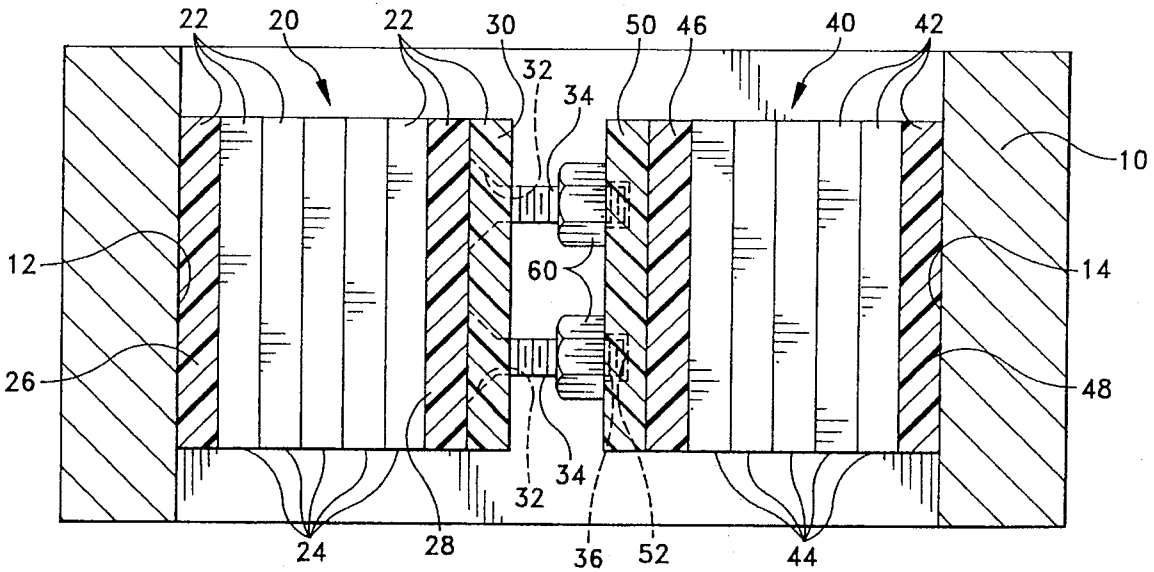
FIG. 2 is a sectional view, taken along line 2—2 of FIG. 1.
Figure 3:
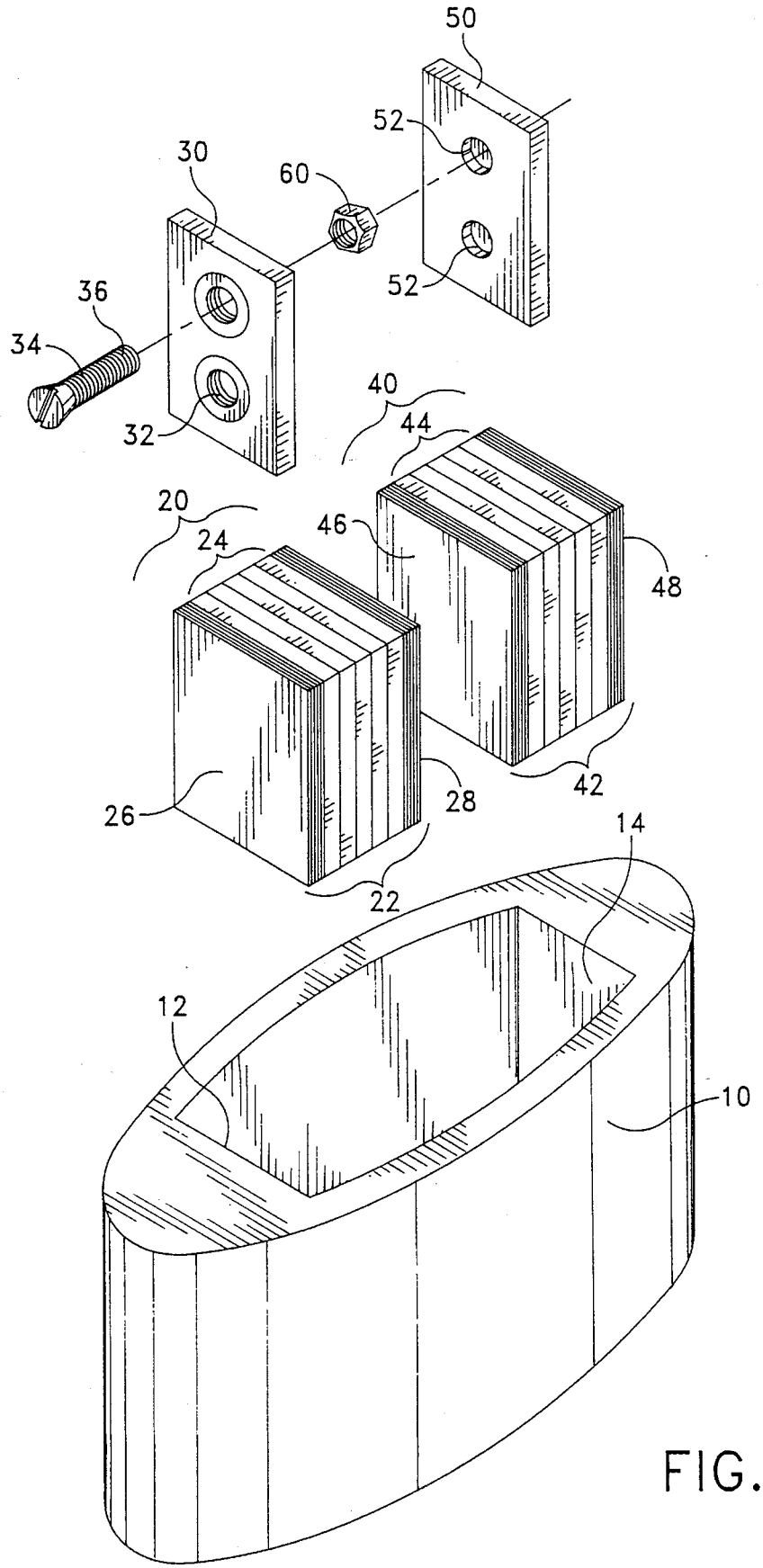
FIG. 3 is an exploded perspective view of the transducer of FIGS. 1 and 2.

It is to be understood that the present invention is by no means limited to the particular construction herein disclosed and/or shown in the drawings, but also comprises any modifications or equivalents within the scope of the claims. For example, the transduction plates 24, 44 may utilize piezoelectric, magnetostructive, or electrostrictive effects to produce mechanical vibration. Each of the three types of plates undergo deformation in shape when subjected to electrical current. All of the plates will fracture if they are allowed to develop tensile stresses. Accordingly, all three types of plates must be kept in compression by mechanical bias to minimize failure of plates. The particular transducer shown in FIGS. 1–3 is of a type commonly known in the art as "Class IV flextensional" and is of the piezoelectric type; however, the invention herein finds applicability to all three types.

What is claimed is:

1. An acoustic transducer comprising:

a housing;

first and second stacks of plates, including transduction plates, disposed within said housing for engaging opposed wall portions of said housing, said first and second stacks being adapted to be held in compression between said housing opposed wall portions;

a threaded stud extending from said first stack to said second stack; and a nut threadedly engaged with said stud and adjacent one of said stacks;

whereby movement of said nut on said stud operates to move said stacks toward said housing walls, respectively, to compress said stacks, and to relax compressive force on said stacks to enable withdrawal of one of said stacks of plates and replacement thereof.

2. The transducer in accordance with claim 1 wherein each of said stacks includes said transduction plates disposed between electrically insulating plates.

3. The transducer in accordance with claim 2 wherein each of said stacks is provided with a metal plate fixed to one of said insulating plates, said metal plates opposing each other, said stud extending from a first of said metal plates and received in a recess in the other of said metal plates.

4. The transducer in accordance with claim 3 wherein said nut abuts said other of said metal plates.

5. The transducer in accordance with claim 3 wherein said first metal plate has a hole therein, said stud is fixed in said hole, and said first metal plate is bonded to one of said insulating plates of said first stack.

6. An acoustic transducer comprising:

a first stack of first plates, said first plates comprising a first plurality of transduction plates disposed between first and second insulating plates, and a first metal plate disposed adjacent one of said first and second insulating plates, and a threaded stud extending outwardly from said first metal plate in a direction lengthwise of said first stack;

a second stack of second plates, said second plates comprising a second plurality of transduction plates disposed between third and fourth insulating plates, and a second metal plate disposed adjacent one of said third and fourth insulating plates, said second metal plate having a recess therein for retaining an end portion of said stud;

a transducer shell surrounding said first and second stacks and having therein a first wall abutting the other of said first and second insulating plates, and a second wall abutting the other of said third and fourth insulating plates; and a nut threadedly mounted on said stud and abutting said second metal plate;

whereby turning of said nut on said stud serves to compress said stacks and thereby said transduction plates, and to release compression of said stacks to permit withdrawal of one or more of said stacks of plates and replacement thereof, and withdrawal of one or more of said plates of one or more of said stacks and replacement thereof.

* * * * *